US008522690B2

(12) United States Patent
Smith et al.

(10) Patent No.: US 8,522,690 B2
(45) Date of Patent: Sep. 3, 2013

(54) IDENTIFICATION OF AN ANOMALOUS ORIENTATION DEFINITION CONDITION OF A REMOTE LOCOMOTIVE OF A TRAIN

(75) Inventors: Eugene A. Smith, Satellite Beach, FL (US); Stephen D. Smith, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 1616 days.

(21) Appl. No.: 11/401,663

(22) Filed: Apr. 11, 2006

(65) Prior Publication Data

US 2007/0239327 A1 Oct. 11, 2007

(51) Int. Cl.
*B60Q 1/00* (2006.01)

(52) U.S. Cl.
USPC ..... 105/26.05; 701/20; 246/167 R; 303/7

(58) Field of Classification Search
USPC ..... 701/19, 20, 412; 340/438, 310.01; 246/167 R, 167, 186, 187 A; 105/26.05; 303/7
See application file for complete search history.

(56) References Cited

U.S. PATENT DOCUMENTS 5,738,311 A 4/1998 Fernandez
5,969,643 A * 10/1999 Curtis ..... 340/988
6,049,296 A * 4/2000 Lumbis et al. ..... 340/933
6,401,015 B1 6/2002 Stewart et al.
6,434,452 B1 8/2002 Gray
6,456,937 B1 * 9/2002 Doner et al. ..... 701/482
6,490,523 B2 * 12/2002 Doner ..... 701/482
6,972,670 B2 * 12/2005 LaDuc et al. ..... 340/438
6,997,418 B1 2/2006 Sanzone
7,021,588 B2 4/2006 Hess, Jr. et al.
2004/0267450 A1 * 12/2004 Kernwein ..... 701/213
2005/0189815 A1 9/2005 Bryant
2006/0138285 A1 * 6/2006 Oleski et al. ..... 246/167 R
2007/0239327 A1 10/2007 Smith et al.
2007/0241237 A1 10/2007 Foy et al.

FOREIGN PATENT DOCUMENTS

WO WO 01/49545 7/2001

* cited by examiner

*Primary Examiner* — Ronnie Mancho

(74) *Attorney, Agent, or Firm* — GE Global Patent Operation; John A. Kramer

(57) ABSTRACT

A method of identifying an anomalous orientation definition condition of a remote locomotive (12) of a train includes monitoring an operating condition of the remote locomotive of the train, the remote locomotive configured to operate according to a defined orientation with respect to a lead locomotive of the train. The method also includes identifying an operating condition of the remote locomotive indicative of the remote locomotive operating contrary to an operating condition of the lead locomotive.

14 Claims, 1 Drawing Sheet

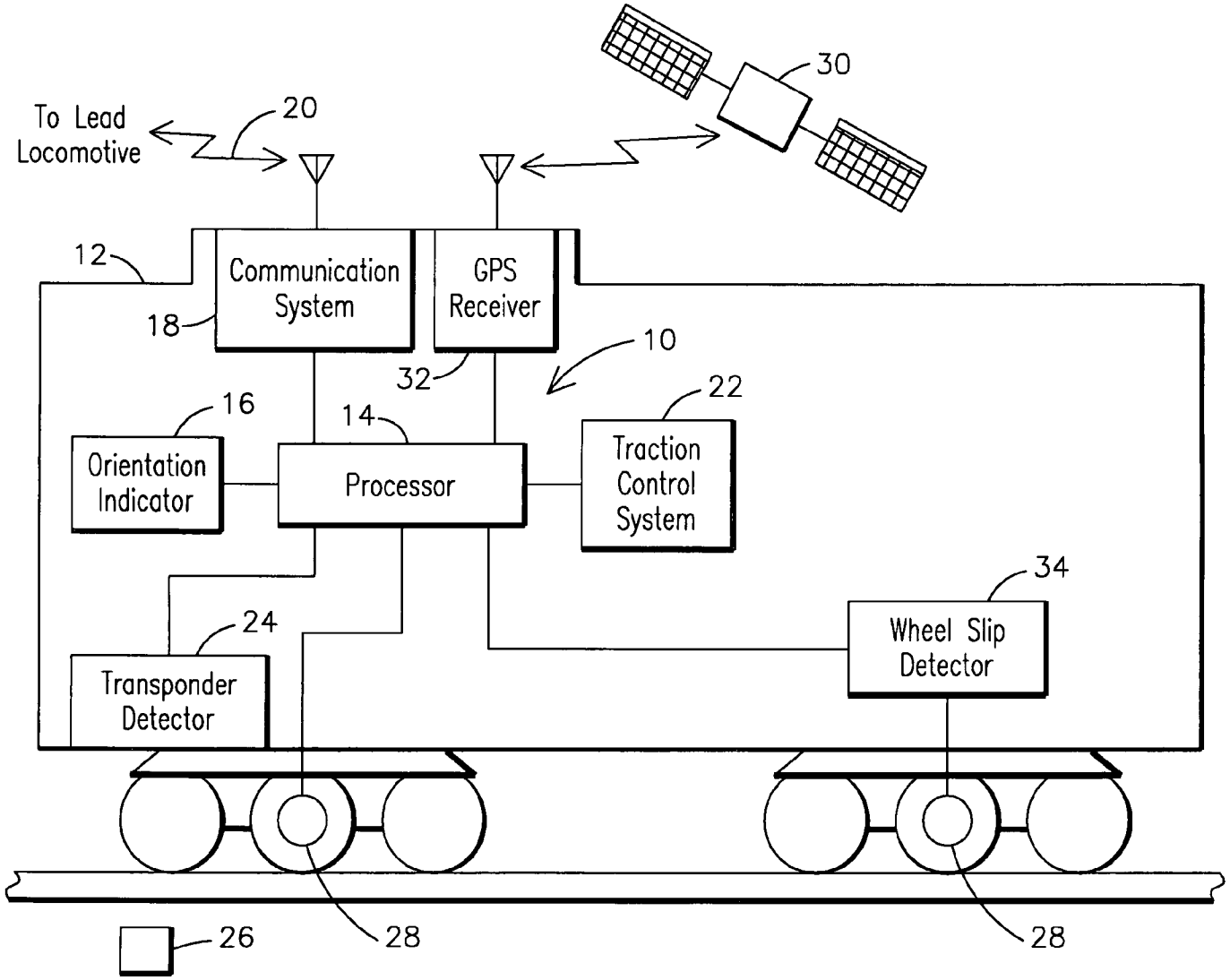
30
GPS Receiver
32
Communication System
18
20
To Lead Locomotive
12
10
22
Traction Control System
14
Processor
16
Orientation Indicator
34
Wheel Slip Detector
24
Transponder Detector
28
28
26

IDENTIFICATION OF AN ANOMALOUS ORIENTATION DEFINITION CONDITION OF A REMOTE LOCOMOTIVE OF A TRAIN

FIELD OF THE INVENTION

This invention relates generally to the field of locomotive control, and more particularly to identifying an anomalous orientation definition of a remote locomotive of a distributed power train.

BACKGROUND OF THE INVENTION

Distributed power train operation supplies motive power from a lead locomotive and one or more remote locomotives spaced apart from the lead locomotive in a train consist. Remote locomotives may be equipped with onboard remote control system responsive operation commands transmitted from the lead locomotive to the remote locomotive over a wired or wireless communications link for controlling an operation of the remote locomotive.

In assembling a distributed power train, a remote locomotive of the train may be setup to operate in the same orientation as the lead locomotive, such as lead short hood forward and remote short hood forward. Accordingly, when the lead is being operated in a forward direction, the remote is also commanded via the distributed power system to operate in the forward direction. Alternatively, a remote locomotive of the train may be setup to operate in an opposite orientation for the lead locomotive, for example, lead short hood forward and remote long hood forward. Accordingly, when the lead is being operated in a forward direction, the remote is commanded via the distributed power system to operate in the opposite, or reverse direction. This ability allows remote locomotives of the distributed power train to be assembled in the train in a forward or reverse and still provide traction in the same direction as the lead locomotive.

Typically, an orientation of a remote locomotive is established by an operator as part of a distributed power setup procedure when assembling a distributed power train. For example, an operator may use a "Same/Opposite" direction indicator, such as a switch or setup screen, on-board a distributed power enabled remote locomotive to define the remote's orientation with respect to the lead locomotive of a distributed power train being assembled. For example, if the remote locomotive's in-train orientation is the same as the lead locomotive's orientation, the orientation indicator is set to "Same." Conversely, if the remote locomotive's orientation is opposite to the lead locomotive's orientation, the orientation indicator is set to "Opposite." The remote on-board control system interprets traction commands provided by the lead locomotive according to the setting of the orientation indicator. For example, when the orientation indicator is set to the same orientation and a forward traction command is given by the lead locomotive, the remote locomotive interprets this command by applying traction in the forward direction. Conversely, when the orientation indicator is set to the opposite orientation and a forward traction command is given by the lead locomotive, the remote locomotive interprets this command by applying traction in the reverse direction.

BRIEF DESCRIPTION OF THE DRAWINGS

The sole FIGURE is a schematic diagram of an exemplary system for identifying an anomalous orientation definition of a remote locomotive of a distributed power train.

DETAILED DESCRIPTION OF THE INVENTION

In conventional distributed power trains, there is no indication provided to an operator at a lead locomotive of the setup condition, or defined orientation, of a remote locomotive of the train. In particular, there is no indication that notifies an operator at the lead locomotive that a remote locomotive may have had its orientation improperly defined. Consequently, there have been cases of a lead locomotive and a remote locomotive having an improper orientation definition pulling a distributed power train in different directions, resulting in damage to the locomotives and railcars of the distributed power train. Accordingly, the inventors have developed an innovative system and method for detecting an improperly defined orientation of a remote locomotive of a distributed power train so that an undesired operation of the remote locomotive may be avoided.

The sole FIGURE is a schematic diagram of an exemplary system 10 for detecting an improperly defined orientation of a remote locomotive 12 of a distributed power train. The system 10 may include a processor 14 on board the remote locomotive 12 in communication with an orientation indicator 16 for allowing an operator to setup, or define, an orientation of the remote locomotive 12 with respect to an orientation of a lead locomotive (not shown). Processor 14 may take any form known in the art, for example an analog or digital microprocessor or computer, and it may be integrated into or combined with one or more controllers used for other functions related to the operation of the remote locomotive 12. The system 10 may also include a wireless communication system 18 for communicating wirelessly with a lead locomotive via communication link 20. The processor 14 may interpret commands received via the wireless communication system 18 according to an orientation of the remote locomotive 12 defined via the orientation indicator 16 to directly or indirectly control a traction control system 22 of the remote locomotive 12 responsive to the commands.

In an embodiment of the invention, the processor 14 may receive remote locomotive location information via a global position satellite (GPS) receiver 32 in communication with a GPS satellite 30. In another embodiment, the processor 14 may receive locomotive location information relative to a rail bed transponder 26, such as a track magnet, via one or more transponder detectors 24. Transponder detectors 24 may be positioned at certain locations on the remote locomotive 12, such as at front and back ends and/or left and right sides of the locomotive 12. The transponder detector(s) 24 enable the processor 14 to determine an orientation of the locomotive 12 with respect to the rail bed transponder 26, for example, depending on which of the detectors 24, such as a left side detector or a right side detector, senses the transponder 26. In another embodiment, the processor 14 may receive wheel speed and/or wheel rotation direction information from one or more axle generators 28. The processor 14 may also receive wheel slip information from a wheel slip detector 34. The wheel slip information may be derived wheel slip detector 34 from information provided by an axle generator 28.

In an embodiment of the invention, the processor 14 may be configured to implement steps for identifying an anomalous orientation definition of a remote locomotive in response to a sensed operating condition of the locomotive, such as a movement or function of the locomotive. For example, the processor 14 may identify the anomalous orientation definition based on a setting of the orientation indicator 16 and inputs provided by one or more sources 24, 28, 32, 34. The steps necessary for such processes may be embodied in hardware, software and/or firmware in any form that is accessible and executable by processor 14 and may be stored on any medium that is convenient for the particular application.

The steps performed by the processor 14 may include monitoring an operating condition of the remote locomotive 12 being identified, for example, by an operator using the orientation indicator, as having a defined orientation with respect to a lead locomotive of the train. The steps may also include identifying an operating condition of the remote locomotive indicative of the remote locomotive operating, such as moving or functioning, contrary to an operating condition of the lead locomotive, such as by pulling the train in an opposite direction from the lead locomotive. When the operating condition of the remote locomotive 12 indicates that the remote locomotive 12 is operating contrary to the lead locomotive, the steps may include providing a notification to an operator of the train indicative of an anomalous orientation definition condition, thereby allowing the operator to correct the anomalous condition if necessary. In another aspect, when the operating condition of the remote locomotive 12 indicates that the remote locomotive 12 is operating contrary to the lead locomotive, the steps may include automatically reducing a traction condition of the remote locomotive 12, such as by setting the traction condition of the remote locomotive 12 to an idle state so that the remote locomotive 12 provides no motive power to the train.

In an embodiment of the invention, the step of identifying an operating condition of the remote locomotive 12 may include identifying a movement of remote locomotive 12 opposite to a direction commanded by the lead locomotive. The steps may include sensing a direction of movement of the remote locomotive 12 and determining when a sensed direction of movement is opposite to a direction commanded by the lead locomotive, even though the direction of movement of the remote locomotive 12 may be correct according to its defined orientation. For example, by monitoring a lead locomotive commanded traction direction, the defined orientation of the remote locomotive, and a sensed movement of the remote locomotive, an incorrect orientation designation of the remote locomotive 12 may be identified. In an aspect of the invention, movement direction information may be obtained, for example, via an axle generator 28 providing wheel rotation direction information, a GPS signal indicative of movement from one location to another location, and/or transponders positioned along a track over which the remote locomotive 12 is traveling.

In another embodiment, identifying an operating condition may include identifying an anomalous wheel slip and/or skid condition of the remote locomotive 12. Identifying an anomalous wheel slip condition may including identifying a sustained wheel slip condition of the remote locomotive 12, such as wheel slip being sustained for longer than about a minute. In another aspect, identifying an anomalous wheel slip condition may include identifying a relatively higher frequency of occurrence of a wheel slip condition than would be expected to occur when the remote locomotive 12 is operating according to the defined orientation. For example, when a number of wheel slip events exceed a predefined limit within a predefined time period, such as about 10 wheel slip events in about 2 minutes, a remote direction orientation fault may be declared and the operator of the train notified.

In another embodiment, identifying an operating condition indicative of an anomalous remote locomotive orientation setting may include identifying a speed difference between the remote locomotive 12 and the lead locomotive indicative of the locomotives traveling in opposite directions. When traveling in the same direction, the lead locomotive's and remote locomotive's speeds should be about the same speed. However, if the remote locomotive 12 has an improper orientation setting and is attempting to pull the train in an opposite direction than the lead locomotive, the remote locomotive 12 may experience wheel slip and/or skid resulting in a different speed being sensed at the remote locomotive 12 due to slipping and/or skidding of the wheels.

In another embodiment, identifying an operating condition indicative of an anomalous orientation setting may include identifying an anomalous track transponder 26 sensing condition indicative of the remote locomotive 12 being physically oriented in the train contrary to the defined orientation. For example, if a transponder 26 is detected on of the remote locomotive 14 opposite to a side on which detection was expected, or if a track transponder 26 is unexpectedly sensed at one end of the remote locomotive 12 before an opposite end at which first detection was expected, an anomalous orientation designation may be declared.

Based on the foregoing specification, the invention may be implemented using computer programming or engineering techniques including computer software, firmware, hardware or any combination or subset thereof, wherein the technical effect is to identify an anomalous orientation definition of a remote locomotive of a distributed power train. Any such resulting program, having computer-readable code means, may be embodied or provided within one or more computer-readable media, thereby making a computer program product, i.e., an article of manufacture, according to the invention. The computer readable media may be, for instance, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system embodying the method of the invention. An apparatus for making, using or selling the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody the invention.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

We claim:

1. A method comprising:

wirelessly monitoring a sensed operating condition of a remote locomotive in a train, wherein the train also includes a lead locomotive, the sensed operating condition including a first direction of movement of the remote locomotive; and determining when the sensed operating condition of the remote locomotive indicates that the remote locomotive is operating contrary to an operating condition of the lead locomotive, the operating condition of the lead locomotive including a second direction of movement of the lead locomotive, the sensed operating condition of the remote locomotive being contrary to the operating condition of the lead locomotive when the first direction of movement of the remote locomotive is different from the second direction of movement of the lead locomotive, wherein determining when the sensed operating condition of the remote locomotive indicates that the remote locomotive is operating contrary to the operating condition of the lead locomotive occurs when the first direction of movement of the remote locomotive is opposite of a direction of movement that is commanded by the lead locomotive.

2. The method of claim 1, further comprising, when the sensed operating condition of the remote locomotive indicates that the remote locomotive is operating contrary to the operating condition of the lead locomotive, providing a notification to an operator of the train indicative of an anomalous defined orientation condition.

3. The method of claim 1, further comprising, when the sensed operating condition of the remote locomotive indicates that the remote locomotive is operating contrary to the operating condition of the lead locomotive, automatically reducing a traction condition of the remote locomotive.

4. The method of claim 3, wherein reducing the traction condition comprises setting the remote locomotive to an idle state so that the remote provides less motive power to the train relative to the motive power provided before setting the remote locomotive to the idle state.

5. The method of claim 1, wherein monitoring the sensed operating condition of the remote locomotive comprises identifying locations of the remote locomotive.

6. The method of claim 1, wherein the first direction of movement of the remote locomotive represents a direction along a track that the remote locomotive moves when the remote locomotive provides motive power to move forward.

7. The method of claim 1, where wirelessly monitoring the sensed operating condition includes obtaining location information from a Global Positioning System (GPS) receiver and identifying the first direction of movement of the remote locomotive based on the location information.

8. A method comprising:

receiving an orientation definition for a remote locomotive in a train, the train also having a lead locomotive;

wirelessly monitoring a sensed operating condition of the remote locomotive, the sensed operating condition including a first direction of movement of the remote locomotive; and determining when the sensed operating condition of the remote locomotive indicates that the remote locomotive is operating contrary to an operating condition of the lead locomotive, the operating condition of the lead locomotive representing a second direction of movement of the lead locomotive, the sensed operating condition of the remote locomotive being contrary to the operating condition of the lead locomotive when the first direction of movement of the remote locomotive is different from the second direction of movement of the lead locomotive, wherein determining when the sensed operating condition of the remote locomotive indicates that the remote locomotive is operating contrary to the operating condition of the lead locomotive occurs when the first direction of movement of the remote locomotive is opposite of a direction of movement that is commanded by the lead locomotive.

9. The method of claim 8, wherein the first direction of movement of the remote locomotive represents a direction along a track that the remote locomotive moves when the remote locomotive provides motive power to move forward.

10. The method of claim 8, where wirelessly monitoring the sensed operating condition of the remote locomotive includes obtaining location information from a Global Positioning System (GPS) receiver and identifying the first direction of movement of the remote locomotive based on the location information.

11. A system comprising:

a sensor configured to wirelessly sense a sensed operating condition of a remote locomotive in a train that represents a first direction of movement of the remote locomotive, the train also including a lead locomotive; and a processor configured to obtain the sensed operating condition of the remote locomotive and to determine when the sensed operating condition of the remote locomotive indicates that the first direction of movement of the remote locomotive differs from a second direction of movement of the lead locomotive, wherein the processor is configured to determine when the sensed operating condition of the remote locomotive indicates that the remote locomotive is operating contrary to the operating condition of the lead locomotive when the first direction of movement of the remote locomotive is opposite of a direction of movement that is commanded by the lead locomotive.

12. The system of claim 11, wherein the sensor comprises a Global Positioning System (GPS) receiver configured to provide locations of the remote locomotive to the processor and the processor is configured to determine the first direction of movement of the remote locomotive based on the locations from the GPS receiver.

13. The system of claim 11, wherein the processor is further configured to provide a notification to an operator of the train when the first direction of movement of the remote locomotive differs from the second direction of movement of the lead locomotive.

14. The system of claim 11, wherein the first direction of movement of the remote locomotive represents a direction along a track that the remote locomotive moves when the remote locomotive provides motive power to move forward.

* * * * *

UNITED STATES PATENT AND TRADEMARK OFFICE

CERTIFICATE OF CORRECTION

PATENT NO. : 8,522,690 B2
APPLICATION NO. : 11/401663
DATED : September 3, 2013
INVENTOR(S) : Smith et al.

It is certified that error appears in the above-identified patent and that said Letters Patent is hereby corrected as shown below:

In the Specification

In Column 4, Line 12, delete "on of" and insert -- on a side of --, therefor.

In Column 4, Line 13, delete "locomotive 14" and insert -- locomotive 12 --, therefor.

Signed and Sealed this
Twenty-seventh Day of May, 2014

Michelle K. Lee

Michelle K. Lee
*Deputy Director of the United States Patent and Trademark Office*